US006116851A

United States Patent [19]

Oklejas, Jr.

[11] Patent Number: 6,116,851

[45] Date of Patent: Sep. 12, 2000

[54] CHANNEL-TYPE PUMP

[75] Inventor: Eli Oklejas, Jr., Monroe, Mich.

[73] Assignee: Fluid Equipment Development Company, LLC, Monroe, Mich.

[21] Appl. No.: 09/116,844

[22] Filed: Jul. 16, 1998

Related U.S. Application Data

[60] Provisional application No. 60/052,898, Jul. 16, 1997.

[51] Int. Cl.[7] ..... F04D 5/00

[52] U.S. Cl. ..... 415/57.3; 415/76

[58] Field of Search ..... 415/55.1, 55.2, 415/55.3, 55.4, 55.5, 55.6, 55.7, 76, 73, 57.3, 57.1, 83

[56] References Cited

U.S. PATENT DOCUMENTS

| | | | |
|---|---|---|---|
| 659,930 | 10/1900 | Kemble | 415/57.3 |
| 893,127 | 7/1908 | Barber | 415/57.3 |
| 1,022,683 | 4/1912 | Kienast | 415/57.3 |
| 1,024,111 | 4/1912 | Anderson | 415/76 |
| 3,563,618 | 2/1971 | Ivanov . | |
| 3,748,057 | 7/1973 | Eskeli . | |
| 4,028,885 | 6/1977 | Ganley et al. | 415/76 |
| 4,029,431 | 6/1977 | Bachl . | |
| 4,255,081 | 3/1981 | Oklejas et al. . | |
| 4,830,572 | 5/1989 | Oklejas et al. . | |
| 4,966,708 | 10/1990 | Oklejas et al. . | |
| 4,983,305 | 1/1991 | Oklejas et al. . | |
| 5,020,969 | 6/1991 | Mase et al. . | |
| 5,049,045 | 9/1991 | Oklejas et al. . | |
| 5,082,428 | 1/1992 | Oklejas et al. . | |
| 5,106,262 | 4/1992 | Oklejas et al. . | |
| 5,154,572 | 10/1992 | Toyoshima et al. . | |
| 5,338,151 | 8/1994 | Kemmner et al. . | |
| 5,499,900 | 3/1996 | Khmara et al. | 415/55.1 |
| 5,702,229 | 12/1997 | Moss et al. | 415/55.4 |
| 5,819,524 | 10/1998 | Bosley et al. . | |

*Primary Examiner*—Edward K. Look
*Assistant Examiner*—Richard Woo
*Attorney, Agent, or Firm*—Artz & Artz, P.C.; Kevin G. Mierzwa

[57] ABSTRACT

A rotary machine such as a pump or turbine has a casing defining a space therein. A fluid channel is formed in the casing and has a plurality of first channel portions fluidically coupled a plurality of second channel portions. The first and second channel portions are separated by the space. A rotor is rotatably coupled within the casing and within the space. The rotor has a plurality of apertures therethrough positioned within the space. The apertures are adjacent to the channel to coupled the first channel portions to the second channel portions.

48 Claims, 9 Drawing Sheets

CHANNEL-TYPE PUMP

RELATED APPLICATIONS

This application claims priority to provisional application Ser. No. 60/052,898 entitled, "Disclosure for Channel-type Pump" filed Jul. 16, 1997.

BACKGROUND ART

The present invention relates generally to rotary machine and more specifically to a pump or turbine rotary machine.

Centrifugal pumps are widely used due to their simplicity of design and generally acceptable efficiency. An inherent problem in many industrial applications is that the pressure generated by a basic centrifugal pump is inadequate. In order to obtain the desired pressure in such cases, many impellers must be used, which is called multi-staging. Multi-staging results in a very complex and expensive rotor and casing. Another approach to generating the desired pressure is to a single impeller at very high speed. High-speed operation requires expensive shaft speed step-up equipment such as gear boxes or belt drives. Moreover such pump are noisy and generally unreliable.

SUMMARY OF THE INVENTION

One object of the invention is to reduce the size and complexity of multi-staged pumps through simplification of the casing and rotor. It is a further object of the invention to develop high pressure at normal speeds of operation while preserving a high degree of simplicity.

In one aspect of the invention, a pump has a generally stationary member with a fluid channel therethrough. The fluid channel has a plurality of first channel portions fluidically coupled to a plurality of second channel portions. The first channel portions and the second channel portions have a space therebetween. A moving member has a plurality of apertures therethrough. The moving member is positioned within the space. The apertures fluidically couple the first portion and the second portion together. The momentum added to the fluid as it passes through the apertures increases the pressure of the fluid.

In a further aspect of the invention, a rotary machine formed according to the present invention has a casing defining a space therein. A fluid channel is formed in the casing and has a plurality of first channel portions fluidically coupled a plurality of second channel portions. The first and second channel portions are separated by the space. A rotor is rotatably coupled within the casing. The rotor has a plurality of apertures therethrough positioned within the space. The apertures are adjacent to the channel to coupled the first channel portions to the second channel portions.

One feature of the invention is that for every pump application a turbine may be formed by reversing the direction of flow through the channels and reversing the direction of rotor rotation.

In a further aspect of the invention a rotary machine formed according to the teachings of the invention may include both a pump channel and a turbine channel sharing a common rotor and the apertures therethrough.

Other features and advantages of the invention will become apparent from the following detailed description which will be read in conjunction with the drawings.

BEST MODE(S) FOR CARRYING OUT THE INVENTION

Figure 1:
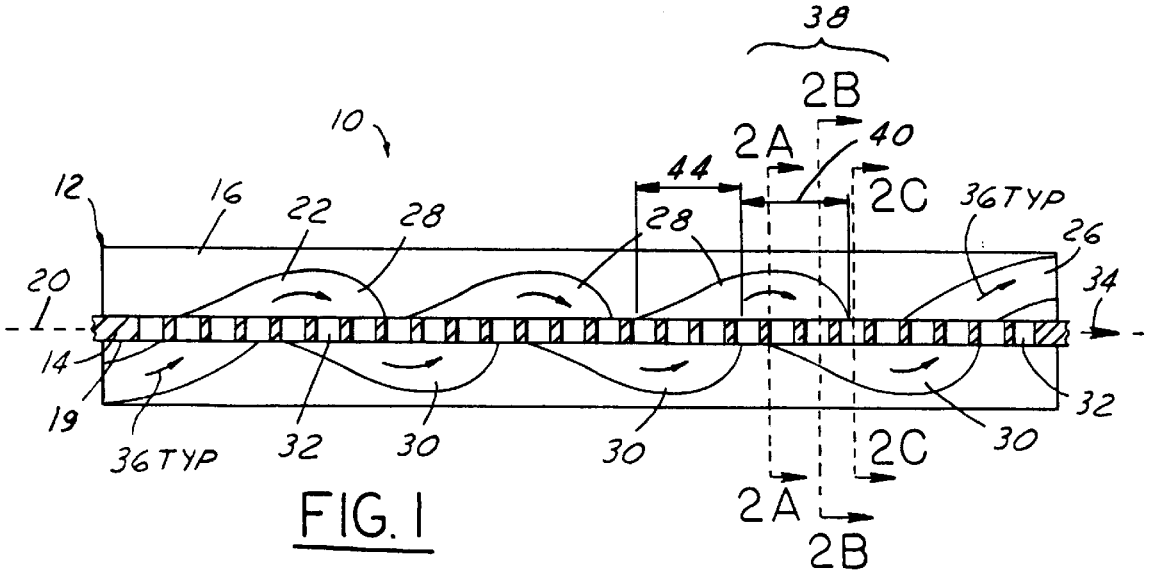
FIG. 1 is a cross-sectional view of a pump formed according to the present invention.
Figure 2A:
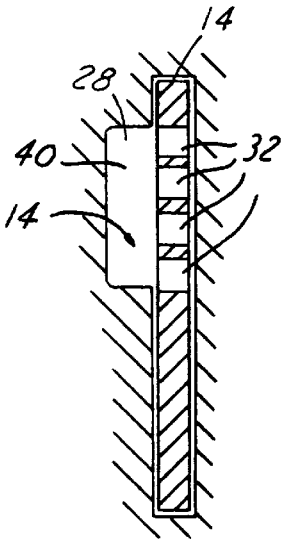
FIG. 2A is a cross-sectional view of a portion of the fluid channel along line 2A—2A of FIG. 1.
Figure 2B:
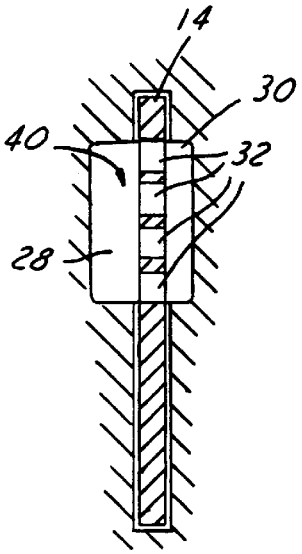
FIG. 2B is a cross-sectional view of another portion of the fluid channel along line 2B—2B of FIG. 1.
Figure 2C:
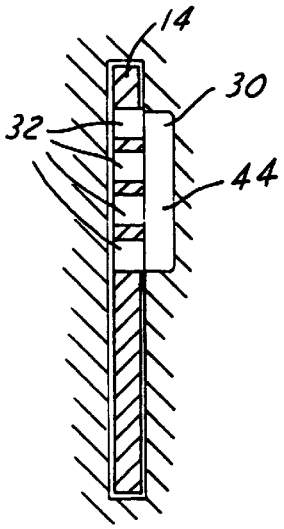
FIG. 2C is a cross-sectional view of yet another portion of the fluid channel along line 2C—2C of FIG. 1.
Figure 3:
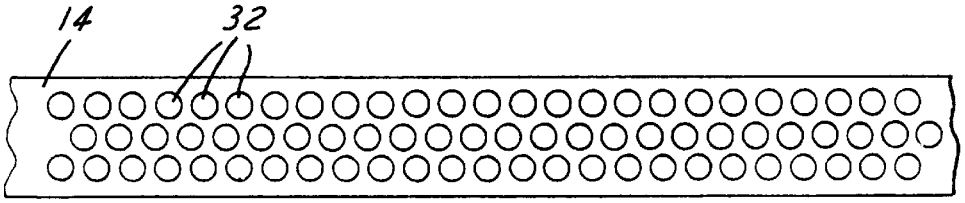
FIG. 3 is a partial elevational view of a moving member having cylindrical-shaped apertures of the present invention.

Referring now to FIGS. 1 to 3, a pump 10 is illustrated having a stationary member 12 and a moving member 14. For simplicity and ease of description, FIGS. 1–3 are illustrated in a linear manner. As will be shown and described below the linear machine is preferably applied to a rotary machine such as a rotary turbine or pump. In such a case moving member 14 is a rotor.

Stationary member 12 has an upper portion 16 and a lower portion 18 separated by a space 19. Stationary member 12 has a longitudinal axis 20. A flow channel 22 consisting of a generally sinusoidal configuration is generally centered about longitudinal axis 20. Flow channel 22 has an input 24 and an output 26 and has a common longitudinal axis 20. Flow channel 22 is separated by space 19 and by longitudinal axis 20 into a plurality of upper portions 28 and a plurality of lower portions 30.

Moving member 14 travels axially along longitudinal axis 20 of flow channel 22. Moving member 14 is perforated with a number of apertures 32 therethrough. Apertures 32 establish fluid communications between upper portion 28 and lower portion of channel 22. Apertures 32 may be cylindrical in shape.

Channel 22 is filled with a fluid desired to be pumped at input 24. Flat member 14 with perforations 32 traveling in the direction indicated by arrow 34 engages the fluid in the channel 22 and causes the fluid to move in the direction of travel indicated by arrows 36. Such movement causes the fluid to repeatedly pass through apertures 32. The fluid moves generally in same direction as the motion of moving member 14. The repeated passage of the fluid through the moving apertures 32 ensures that the fluid is fully engaged by moving member 14. Moving member 14 may be viewed as being infinitely long and moving at a steady velocity thereby establishing a steady fluid flow through channel 22.

As described above, channel 22 is a series of connected upper portions 28 and lower portions 30. The shape or cross-sectional area of upper portion 28 and lower portion 30 varies along the fluid path. Upper portions 28 and lower portions 30 are preferably shaped in a similar manner. In FIG. 2A, the channel sections between sections 2A and 2C define a stage 38. The typical stage description may be applied equally to all upper portions 28 and lower portions 30. As would be evident to those skilled in the art, however, the cross section may be varied from different stages. The first element of stage 38 is a diffuser 40 between sections 2A and 2B. Diffuser 40 reduces the fluid velocity before the fluid enters moving member 14 by having an increased cross-sectional area for the first part of the channel. The reduced velocity causes an increase in pressure at an outlet 42 of diffuser 40.

In the next section of stage 38, which is immediately downstream and in lower portion 30 on the opposite side of moving member 14 from the diffuser 40, a nozzle 44 having a reduced cross-sectional area than diffuser 40 is located between sections 2B and 2C. Nozzle 44 accepts the fluid exiting the moving member 14. The velocity of the fluid at this point is faster than the fluid within the diffuser 40. This velocity increase is due to a transfer of momentum from the moving member 14 to the fluid. The high velocity flow then enters the diffuser in the next stage which converts the velocity increment provided by the moving member 14 into a pressure increase.

Diffuser 40 has a greater cross-sectional flow area than section nozzle 44. The changes in flow area between diffuser 40 and nozzle 44 convert each velocity boost by the moving member into additional pressure. Thus, flow channel 22 consisting of a series of interconnected diffusers 40 and nozzles 44 alternatively located on either side of channel 22 with a moving member 14 with perforations passing axially through the length of channel 22 will create a pumping action on fluid within channel 22.

Figure 4:
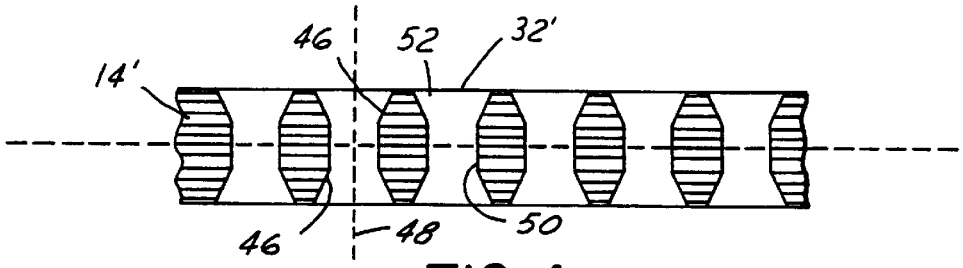
FIG. 4 is a cross-sectional view through a moving member having an alternative embodiment for the shape of the apertures.

Referring now to FIG. 4, an alternative design for moving member 14' is illustrated. Moving member 14' has apertures 32'. Each aperture 32' in moving member 14' has the shape of two axially aligned cones 46 aligned along a common axis 48 and overlapping with each other to form an "hour-glass" shape. A center portion 50 may extend between the cones 46. Center portion 50 is preferably cylindrical in shape. Cones 46 have openings 52 through which fluid enter and exits moving member 14'.

An advantage of aperture 32' is that openings 52 of each aperture 32' at the face of moving member 14' may be in very close proximity to the adjacent aperture 32' to maximize the flow area through moving member 14'. Due to the tapering of each aperture 32' toward center portion 50, there is still enough material to provide adequate strength in moving member 14'The fluid accelerates as it passes through the opening 52 of aperture 32' and reaches a maximum velocity at the narrowest area of aperture 32', center portion 50. The gradually increasing size of the opposite cone 46 down-stream will efficiently convert the velocity of the fluid back into pressure. In general, the maximum diameter of cone 46 is preferably not more than about ⅓ of the width of channel 22 and may be considerably smaller.

Figure 5:
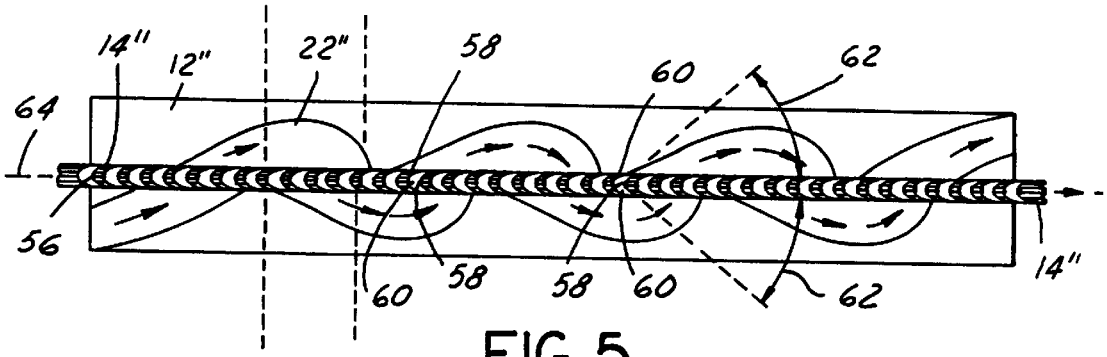
FIG. 5 is a cross-sectional view through a moving member and a stationary member having another alternative embodiment for the shape of the apertures.
Figure 6:
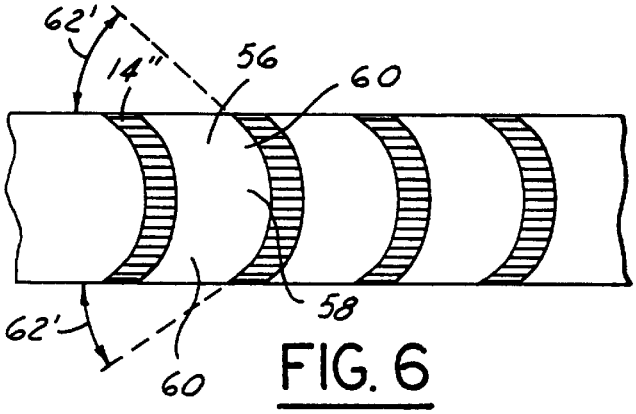
FIG. 6 is a cross-sectional view through a moving member having yet another alternative embodiment for the shape of the apertures.
Figure 7:
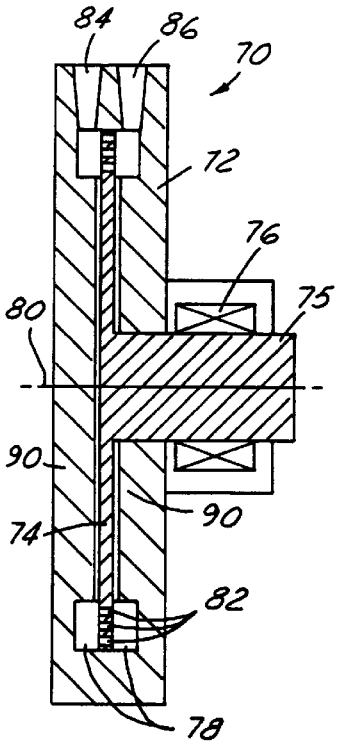
FIG. 7 is an axial cross-sectional view of a rotary machine formed according to the present invention.

Referring now to FIGS. 5 and 6, another two alternative embodiments of moving member 14" are illustrated. Moving member 14" within stationary member 12" has a series of apertures which in these two embodiments will be referred to as vanes 56.

In FIG. 5, vanes 56 are shaped to improve the efficiency of momentum transfer. Vanes 56 have a center portion 58 and end portions 60. End portion 60 has an angle 62 with respect to longitudinal axis 64 of moving member 14". With respect to the fluid flow, the inlet end portion 60 is at an angle opposite to the fluid flow path. The outlet end portion 60 is substantially parallel to the fluid path within channel 22".

In FIG. 6, angle 62' of vane 56 matches the angle of the fluid entering vane 56 from passage 22. Therefore, the fluid enters smoothly and will increase the efficiency of momentum transfer between the moving member 14" and fluid compared with above embodiments.

Referring now to FIGS. 7 to 10, the more general linear machine discussions above are applied to a rotary pump 70. Pump 70 has a casing 72 and a rotor 74 housed in casing 72. Rotor 74 has a shaft 75 coupled thereto. A bearing 76 is used to rotatably couple and position shaft 75 and, thereby, rotor 74 within casing 72. Shaft 75 is caused to rotate in the direction indicated by arrow 77 by an electric motor or other driver (not shown).

A flow channel 78 (similar to that described above as 22) is located in casing 72. Flow channel 78 is centered about a longitudinal axis 80 about which shaft 75 and rotor 74 rotate. Channel 78 has an inlet passage 84 through which fluid is introduced and an outlet passage 86 through which a fluid having a higher pressure is discharged from pump 70.

Figure 9:
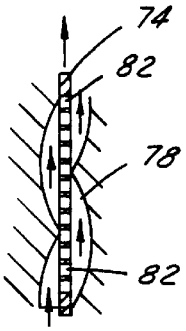
FIG. 9 is a partial cross-sectional view of the rotary machine along line 9—9 of FIG. 8 in an axial direction.

Rotor 74 is perforated by apertures 82 along the outer periphery in an aperture region 84 adjacent to the channel 78. FIG. 9 illustrates the orientation of channel 78 with respect to rotor 74 when viewed in the radial direction. An inlet passage 84 allows fluid to enter the sinusoidal passage 78. Inlet passage 84 is oriented so that the fluid will flow in the direction of rotation of rotor 74. The fluid passes through channel 78 as it repeatedly passes through apertures 82. The fluid exits at an outlet passage 86 of channel 78. A close running clearance is preferably maintained between rotor 74 and casing sidewalls 90 to minimize leakage between areas of different fluid pressure. In particular, the close clearance minimizes leakage between the high pressure in outlet passage 86 and the low pressure in inlet passage 84. The proper size of the channel 78 will depend on the desired capacity and the rate of rotation of rotor 74.

Figure 11:
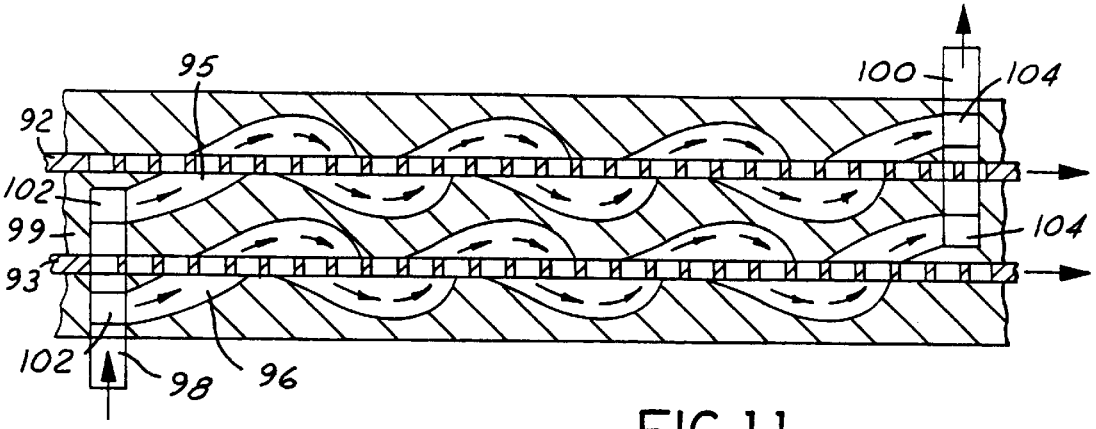
FIG. 11 is partial cross-sectional view of an alternative embodiment of a fluid channel and rotor of the present invention.
Figure 12:
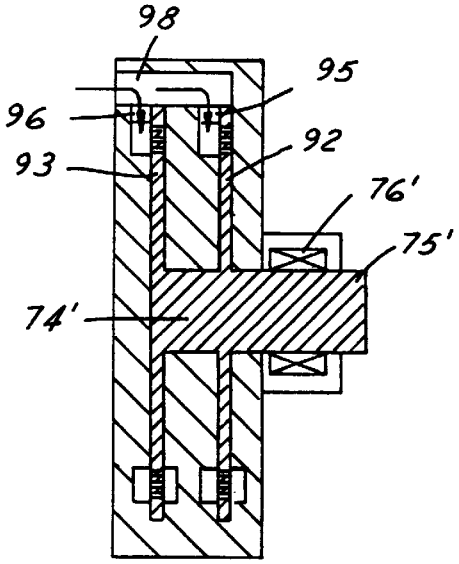
FIG. 12 is a cross sectional view of a rotary machine of FIG. 11.

Referring now to FIGS. 11 and 12, in some cases, the desired flow rate is greater than can be accommodated by a single channel. Rotor 74' has two perforated disc portions 92, 93. Each disc portion 92, 93 has its own associated channel 95 and 96. An inlet manifold 98 is connected to channels 95 and 96, downstream of a sealing area 99. An outlet manifold 100 is connected to channels 95, 96 just upstream of sealing area 99. Inlet manifold 98 is coupled to channels 95, 96 through inlet ports 102. Outlet manifold 100 is coupled to channels 95, 96 by outlet ports 104.

In operation, the fluid enters through the inlet manifold 98 and is distributed to channels 95 and 96 through inlet ports 102. The fluid is forced down the channels by the rotation of rotor 74' and attached disc portions 92 and 93 to outlet manifold 100 through ports 104.

Figure 13:
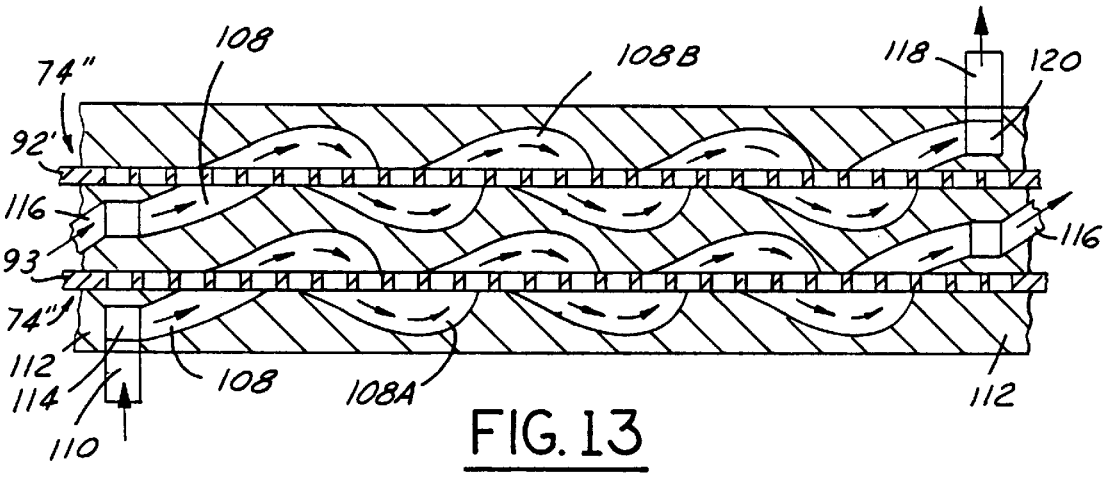
FIG. 13 is a partial cross-sectional view of an alternative embodiment of a fluid channel and rotor of the present invention.

Referring now to FIG. 13, in some cases, the desired pressure at the outlet is greater than can be accommodated efficiently in the length of one channel. An arrangement within which the fluid passes sequentially through several channels with each channel additively increasing the fluid pressure is illustrated. In this embodiment, a single flow channel 108 having two portions 108A and 108B is formed. Inlet manifold 110 is coupled to channel 108A just downstream of a sealing area 112 through a port 114. A cross-over passage 116 connects the ends of channels 108A and 108B. An outlet manifold 118 is connected to channels 108B through a port 120.

In operation, the fluid enters channel 108 through inlet manifold 110. The rotation of disk portion 92', 93' and of rotor 74" moves the fluid to the upstream face of seal area 112 where the fluid passes through the cross-over passage 116 and enters channel 108B at the downstream face of seal area 112. At this point the fluid is at an intermediate pressure. The rotation of rotor 74" moves the fluid down channels 108 until it exits through outlet manifold 118. At this point the fluid has achieved its maximum pressure.

Figure 14:
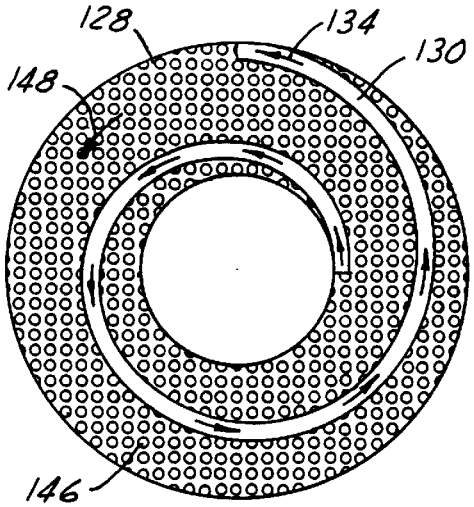
FIG. 14 is an axial elevational view of a rotor in relation to a spiral fluid channel.
Figure 15:
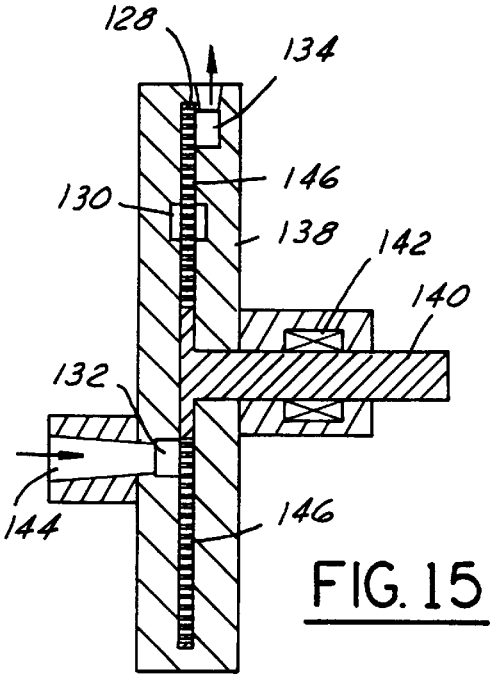
FIG. 15 is an axial cross-sectional view of a rotary machine having a spiral fluid channel.

Referring now to FIGS. 14 and 15, in the above embodiments, much of the rotor to the interior of the channel areas is unused and the fluid entering the channels may not be moving at a velocity roughly equal to the channel velocity. Both conditions may improve the efficiency of the pump. A higher fluid velocity may be obtained by decreasing the fluid pressure in a nozzle just upstream of the channel. In some cases there may be insufficient pressure at the inlet to achieve the required fluid velocity.

To utilize the interior of a rotor 128, a channel 130 has a spiral shape with the inlet 132 preferably located at a radius somewhat less than the outer radius of rotor 128. An outlet 134 of spiral channel 130 is located near the outer radius of rotor 128.

Spiral channel 130, as illustrated, has a total angular extent of about 450 degrees. Depending on the radial width of channel 130, the angular extent may be greater or less than 450 degrees. The length of channel 130 may be much greater than when confined to just the periphery of rotor 128. A greater portion of the face of rotor 130 is active in the pumping process.

In FIG. 15, rotor 128 is surrounded by casing 138. Rotor 128 is attached to a shaft 140. Shaft 140 is supported by bearings 142.

Rotor 128 has apertures 146 therethrough. Apertures 146 extend along the portion of rotor 128 that sweeps an area adjacent to channel 130.

In operation, fluid enters into casing 138 through port 144 and enters channel 130 at inlet 132. In this example, inlet 132 is located a radial distance equal to about 50% of the outer radius of the rotor 128. The fluid is pumped along the length of channel 130 by the interaction of the fluid with apertures 146 in rotor 128 which is rotating in the direction indicated by arrow 148.

Figure 16:
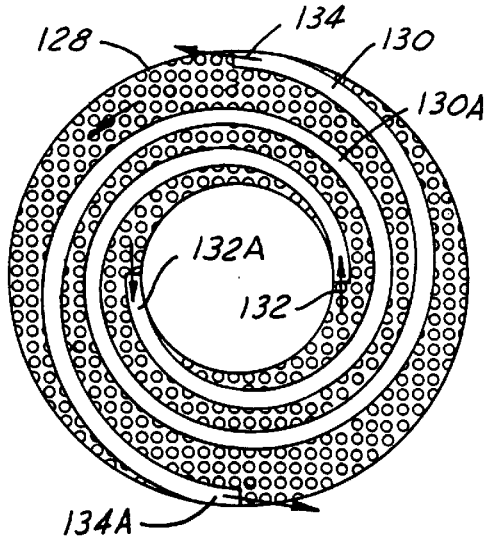
FIG. 16 is an axial elevational view of a rotor in relation to a two spiral fluid channels.

Referring now to FIG. 16, in addition to spiral channel 130, a concentric spiral channel 130A is shown in FIG. 14 and 15. Spiral channel 130A has an inlet 132A and an outlet 134A. If only two spiral channels are used, inlets 132, 132A are preferably positioned 180 degrees apart.

In principle, many spiral channels can be used. However, sufficient separation between the channels is desirable to minimize fluid leakage between the channels.

Figure 17:
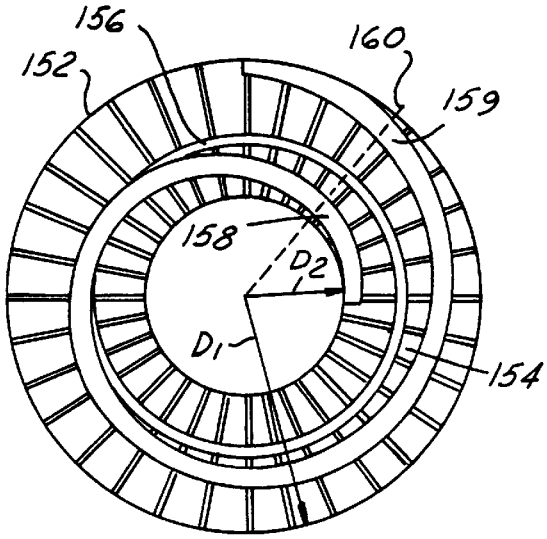
FIG. 17 is an axial elevational view of an alternative embodiment of rotor in relation to a spiral fluid channel.

Referring now to FIG. 17, in the spiral channel embodiments, use of vanes rather than apertures in the rotor may require certain modifications to prevent leakage between stages. A rotor 152 with a series of vanes 154 is illustrated. Vanes 154 extend from outer diameter D1 to an inner diameter D2. A spiral channel 156 passes over the same vane at a first crossing area 158 and a second crossing area 159. The stages at the locations 158 and 159 would be in free communications along the dashed line 160 permitting significant leakage between the associated stages of channel 156. However, a circumferential sealing strip 162 is located between inner diameter D2 and outer diameter D1 to prevent fluid leakage in the radial direction.

Figure 8:
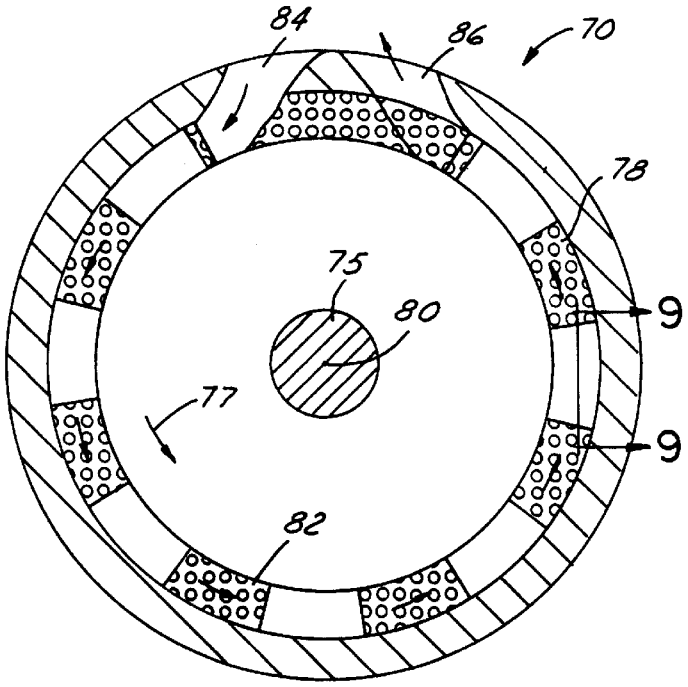
FIG. 8 is a radial cross-sectional view of a rotary machine of FIG. 7.
Figure 10:
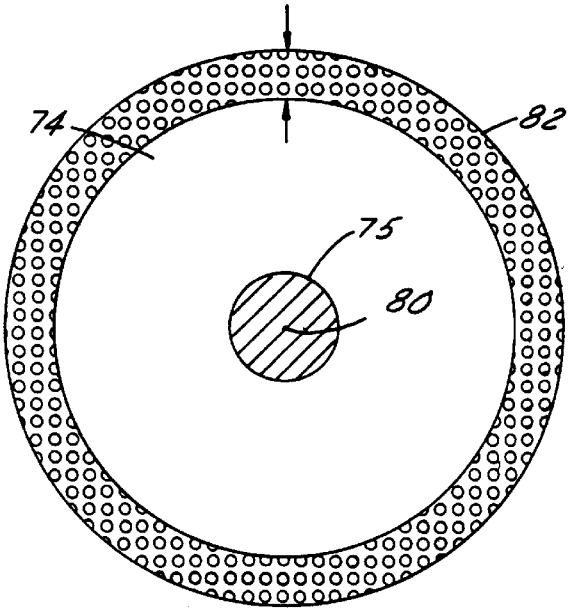
FIG. 10 is an axial elevational view of a rotor of FIGS. 7–9.
Figure 18:
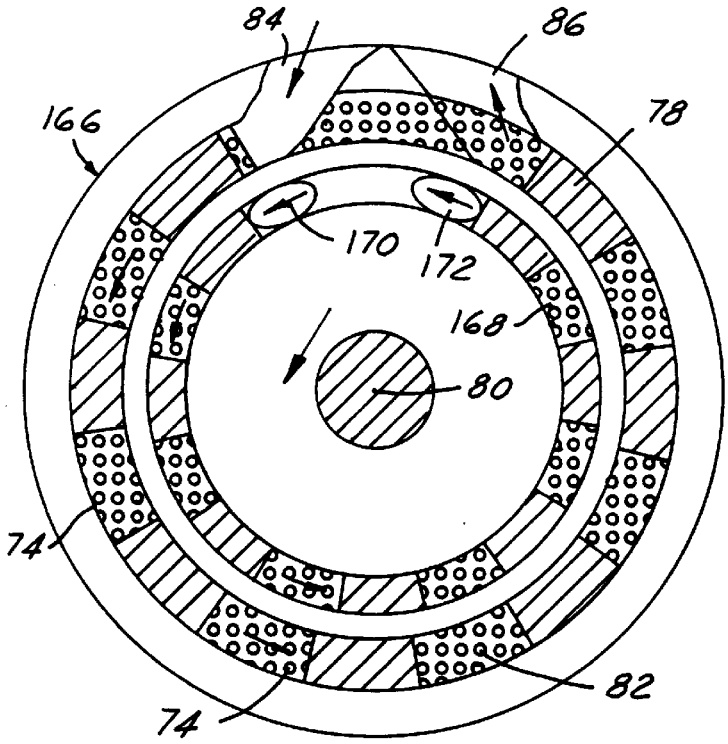
FIG. 18 is a cutaway elevational view of a rotary machine having a pump fluid channel and a turbine fluid channel.
Figure 19:
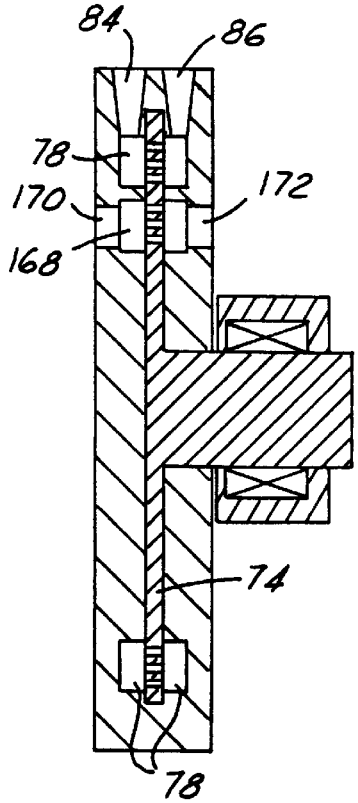
FIG. 19 is a cross-sectional view of the rotary machine of FIG. 18.

Referring now to FIGS. 18 and 19, a pump 166 similar to the pump described in the FIGS. 8, 9 and 10 is illustrated having a turbine channel 168 in addition to flow channel 78. For simplicity, the common elements from FIGS. 8–10 use the same reference numerals. Turbine channel 168 is concentric with and at a smaller radial location than pump channel 78. Turbine channel 168 includes an inlet port 170 for the admission of fluid to turbine channel 168. An outlet port 172 permits the fluid to exit turbine channel 168.

Figure 20:
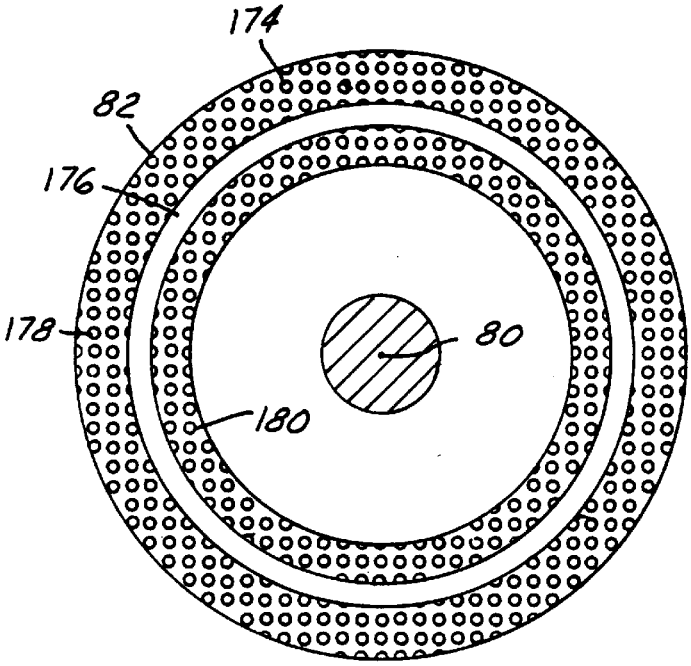
FIG. 20 is an elevation view of the rotor of FIGS. 18 and 19.

FIG. 20 shows a rotor 174 with apertures 82. An unperforated sealing area 176 of rotor 174 is located between an outer perforation area 178 and an inner perforations area 180. Sealing area 176 forms an area that minimizes leakage between pump channel 78 and turbine channel 168. The location of turbine channel 168 is radially inward from pump channel 78. This location is generally preferred to allow greater pressure differentials to be more efficiently accommodated per stage of each turbine channel 168. The reduced length of turbine channel 168 compared to pump channel 78 is not normally a disadvantage.

In operation, the fluid to be pumped enters through pump inlet 84 and flows into pump channel 78. After passing along the length of pump channel 78, the fluid, now pressurized, exits through outlet port 86. High pressure fluid enters the turbine through turbine inlet 170 and flows into turbine channel 168. After passing the length of turbine channel 168, the fluid, now at a lower pressure, exits through turbine outlet 172.

Figure 21:
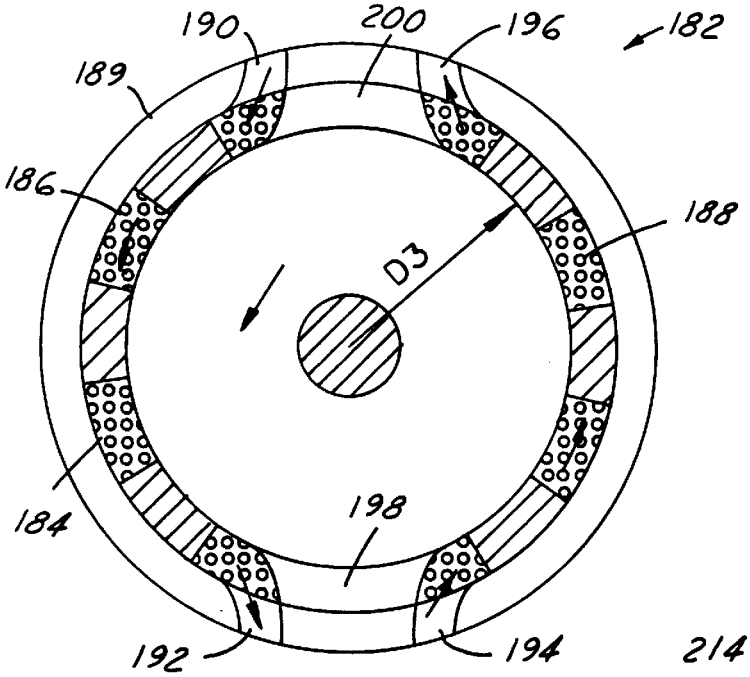
FIG. 21 is a cutaway view of an alternative embodiment of a rotary machine having a turbine fluid channel and a pump fluid channel.

Referring now to FIG. 21, a rotary machine 182 uses the same set of rotor apertures 184 or vanes in both a pump channel 186 and turbine channel 188. Pump channel 186 has a pump inlet 190 and a pump outlet 192. Turbine channel 188 has a turbine inlet 194 and a turbine outlet 196. A pump channel 186 and turbine channel 188 have the same diameter D3. Thus, as a rotor 189 passes pump channel 186 and turbine channel 188, the same area on rotor is traversed.

In many industrial applications, the source of fluid for the turbine is essentially at the same pressure as the intended discharge pressure of the pump. In such cases, the pressure at pump outlet 192 very nearly matches the pressure at the turbine inlet. Thus, there is very little potential for leakage between the two flow channels through the sealing area 198. Likewise, the pressure differential between pump inlet 190 and turbine outlet 196 is very small, minimizing leakage through a seal area 200. In certain cases, the fact the same rotor apertures 184 or vanes pass alternatively through pump channel 186 and turbine channel 188 may be beneficial. For example, in a gas turbine application, pump channel 186 may be compressing relatively cool air for admission to a combustion chamber (not shown). The hot pressurized gases from the combustion chamber will pass through the turbine channel 188. Since apertures 184 will alternately pass through cool and hot gases, the rotor temperature will be maintained at a level somewhat below that of the hot gas thereby allowing higher hot gas temperatures than otherwise possible for a rotor material of a given heat resistance.

Figure 23:
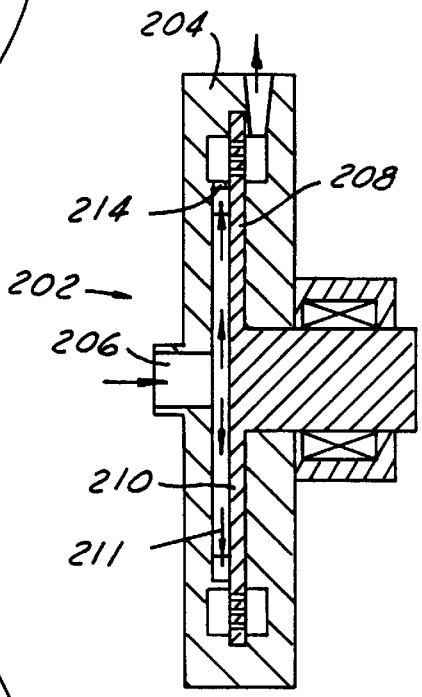
FIG. 23 is a cross-sectional view of the rotary machine of FIG. 22.
Figure 22:
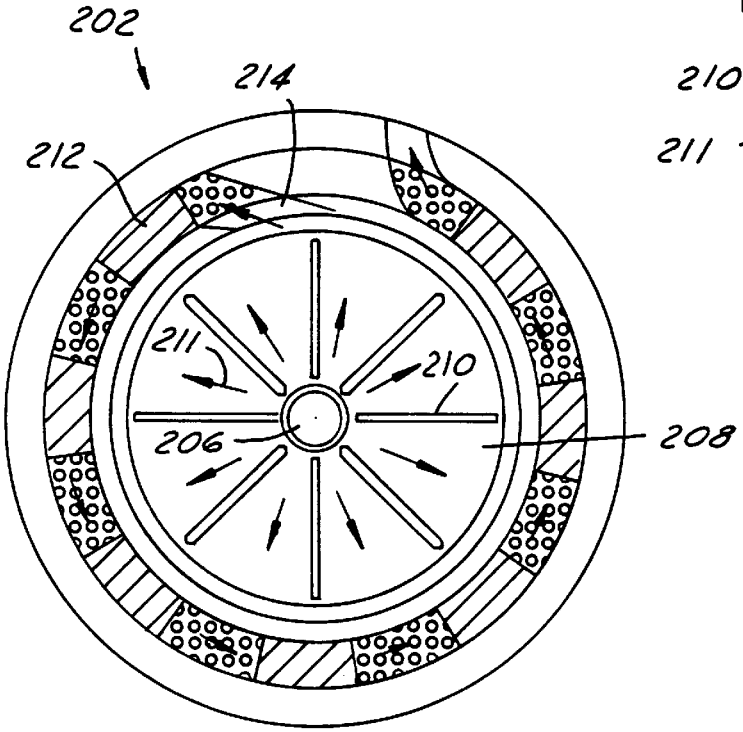
FIG. 22 is a cutaway view of an alternative embodiment of a rotary machine having a central fluid passage and vanes on the rotor.

Referring now to FIGS. 22 and 23, as described above, it is desirable to allow fluid entering the channel to have a velocity approximately equal to the rotor velocity at the point of fluid admission. A pump 202 has a casing 204, which has a central port 206 therethrough. Fluid enters central port 206. Pump 202 also has a rotor 208. A plurality of vanes 210 mounted on rotor 208 engage the fluid. As the fluid moves radially outward in a direction indicated by arrow 211 from central port 206, vanes 210 accelerate the fluid to a velocity nearly matching the velocity of rotor 208 prior to entering a flow channel 212 through an inlet passage 214. This arrangement ensures the appropriate velocity of the fluid prior to entering channel 212. The centrifugal pressure rise generated by the fluid rotation provides additional pressure to the fluid prior to admission to channel 212. The remaining portion of the pump including the apertures and flow channel may be formed according to the teachings above in previous embodiments.

Figure 24:
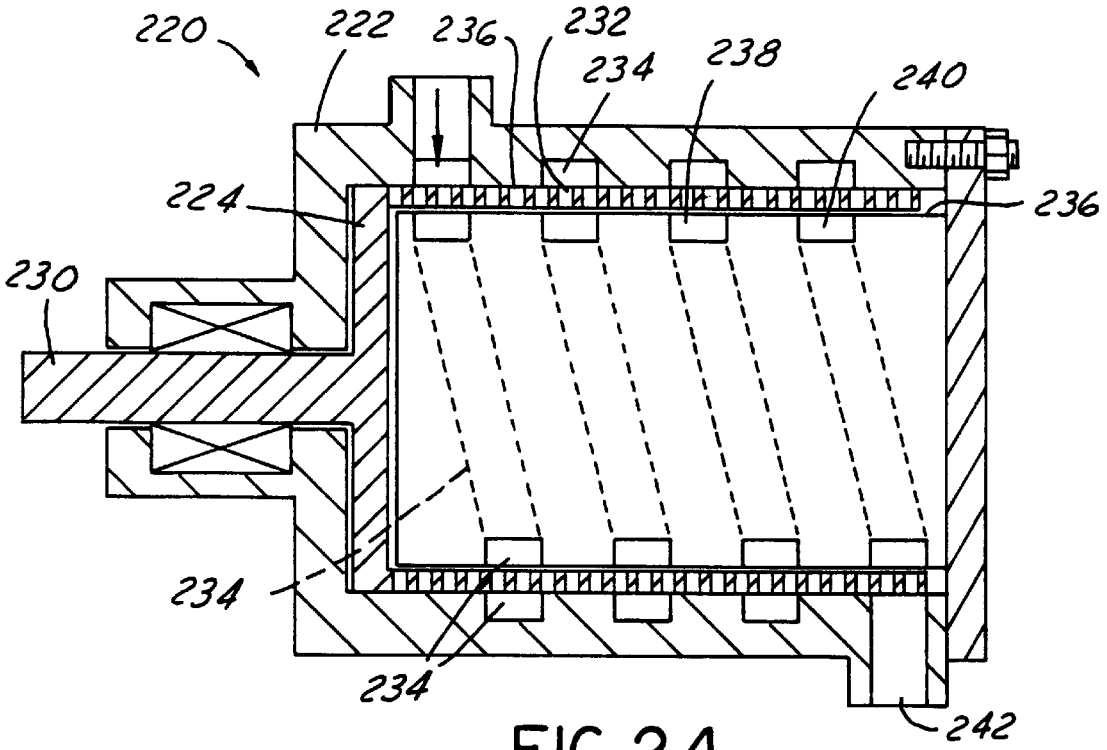
FIG. 24 is a cross sectional view of an alternative embodiment of a rotary machine having a cylindrical rotor and helical fluid channel.

Referring now to FIG. 24, the pressure generation of the pump is in part determined by the number of stages that can be accommodated in the available channel length. In this embodiment, the channel length may be relatively long while maintaining an acceptable rotor diameter. A pump 220 has a casing 222 that encloses a rotor 224. Rotor 224 has a cylindrical portion 226 and an end portion 228. End portion 228 is coupled to a shaft 230, which causes the rotation of cylindrical portion 226. Cylindrical portion of rotor 224 has apertures 232 therethrough similar to the apertures described above in other embodiments.

A channel 234 is wrapped around a fixed cylindrical surface 236 with cylindrical portion 226 of rotor 224 therebetween. Cylindrical portion 226 may be an integral part of casing 222 or a separate piece mounted to casing 222. Channel 234 is helical in shape. Channel 234 has an outer channel portion 238 formed in casing 222 and an inner channel portion 240 formed cylindrical surface 236.

Channel 234 in the outer channel portion 238 and inner portions 240 form a helical path indicated by dashed lines 242.

Figure 25:
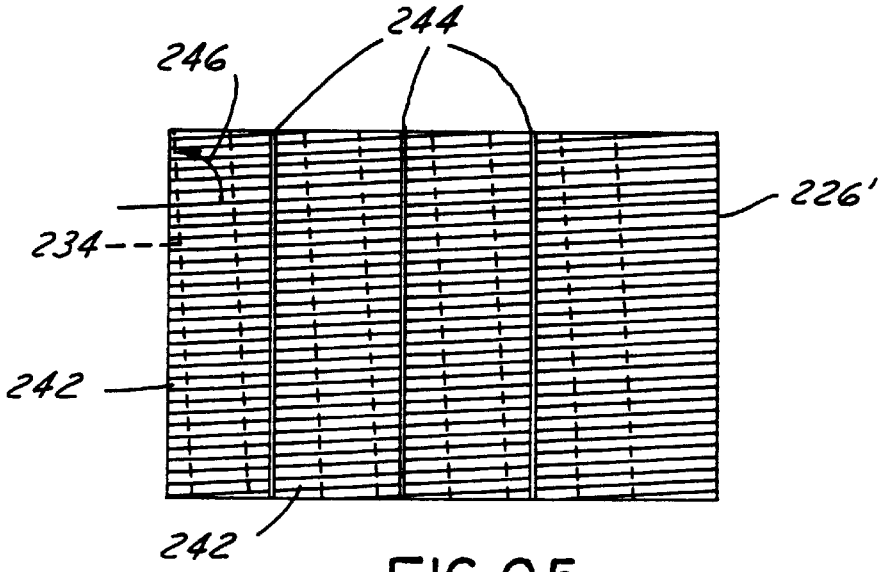
FIG. 25 is an elevational view of an alternative embodiment of a cylindrical rotor for use in the rotary machine of FIG. 24.

Referring now to FIG. 25, the apertures of cylindrical portion 226' in FIG. 24 may be replaced with a plurality of vanes 242. Vanes 242 are oriented generally in an axial direction. Several circumferential sealing strips 244 prevent fluid from flowing axially along vanes 242. For maximum optimization of efficiency, vanes 242 may be oriented at an angle 246 of about 90 degrees with respect to channel 234.

Figure 26:
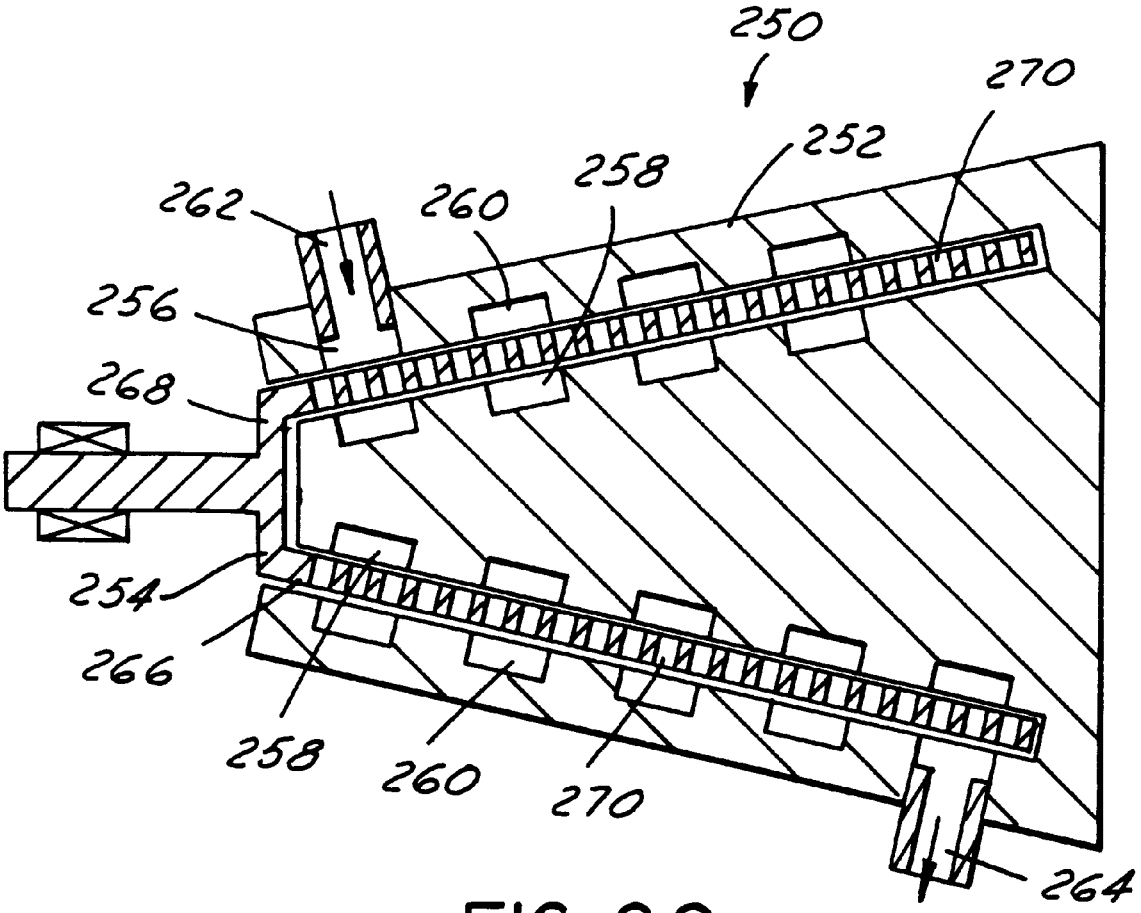
FIG. 26 is a cross-sectional view of another alternative embodiment of a rotary machine having a conical rotor and a helical fluid channel.

Referring now to FIG. 26, a pump 250 has a casing 252 having a conical shape. A rotor 254 contained therein is also generally conical in shape. A flow channel 256 similar to that described in FIGS. 24 and 25 is helical in shape. Channel 256 has an inner channel 258 and an outer channel 260. Rotor 254 fits between the clearance formed by inner channel 258 and outer channel 260. Rotor 254 has a conical portion 266 extending from an end portion 268. Conical portion has apertures 270 therethrough.

In operation, fluid enters through an inlet 262 in casing 252 passes through channel 256 and is discharged through the outlet 264. This configuration combines the improved inlet conditions provided by a spiral channel with a very long channel length possible with the cylindrical channel arrangement.

While the best mode for carrying out the present invention has been described in detail, those familiar with the art to which this invention relates will recognize various alternative designs and embodiments for practicing the invention as defined by the following claims:

What is claimed is:

1. A pump comprising:

a stationary member having a fluid channel therethrough, said channel having a plurality of first channel portions fluidically coupled to a plurality of second channel portions, said first channel portions and said second channel portions having a space therebetween; and a moving member having a plurality of apertures therethrough is positioned within said space, said apertures fluidically coupling said first channel portion and said second channel portion, said plurality of first channel portions, said moving member having a direction of travel, said plurality of second channel portions and said apertures forming a continuous fluid path through the pump;

each of said first channel portions and each of said second channel portions having a diffuser portion having a first cross-sectional area and a nozzle portion having a second cross-sectional area less than said first cross-sectional area, whereby fluid within the plurality of first channel portions and the plurality of second channel portions moves in the direction of travel through the plurality of first channel portions and the plurality of second channel portions.

2. A pump as recited in claim 1 wherein said apertures have a cylindrical cross-sectional shape.

3. A pump as recited in claim 1 wherein said apertures have an hour-glass cross-sectional shape.

4. A pump as recited in claim 3 wherein said hour-glass cross sectional shape has a first cone and a second cone oppositely oriented.

5. A pump as recited in claim 4 wherein said vanes have a vane inlet and a vane outlet, the vane inlet having an angle corresponding to a fluid angle of a fluid path in said channel.

6. A pump as recited in claim 1 wherein said plurality of apertures comprises a plurality of vanes.

7. A pump as recited in claim 1 wherein said fluid channel has said first channel portions in alternating communication with said second channel portions.

8. A pump as recited in claim 1 wherein said fluid channel is generally sinusoidal in shape.

9. A rotating machine comprising:

a casing defining a space therein;

a fluid channel formed in said casing having a plurality of first channel portions fluidically coupled a plurality of second portions, said first channel portions and second channel portions being separated by said space; and a rotor rotatably coupled within the casing, said rotor having a plurality of apertures therethrough positioned within the space, said apertures being adjacent to said channel, said rotor having a direction of travel, said plurality of first channel portions, said plurality of second channel portions and said apertures forming a continuous fluid path through the pump;

each of said first channel portions and each of said second channel portions having a diffuser portion having a first cross-sectional area and a nozzle portion having a second cross-sectional area less than said first cross-sectional area, whereby fluid within the plurality of first channel portions and the plurality of second channel portions moves in the direction of travel through the plurality of first channel portions and the plurality of second channel portions.

10. A pump as recited in claim 9 wherein said apertures have a cylindrical cross-sectional shape.

11. A rotating machine as recited in claim 9 wherein said apertures have an hour-glass cross-sectional shape.

12. A rotating machine as recited in claim 11 wherein said hour-glass cross-sectional shape has a first cone and a second cone oppositely oriented from said first cone.

13. A rotating machine as recited in claim 9 wherein said plurality of apertures comprises a plurality of vanes.

14. A rotating machine as recited in claim 13 wherein said vanes have a vane inlet and a vane outlet, the vane inlet having an angle corresponding to a fluid angle.

15. A rotating machine as recited in claim 9 wherein said fluid channel is generally sinusoidal in shape.

16. A rotating machine as recited in claim 9 wherein said casing defines a second space therein, said rotor comprise s a first disc portion and a second disc portion, said first disc portion positioned within said first space and said second disc portion positioned within said second space.

17. A rotating machine as recited in claim 9 further comprising a first fluid channel having a first end and a second end and a second fluid channel having a first end and a second end, said first channel and said second channel adjacent to said first disc and said second disc respectively.

18. A rotating machine as recited in claim 17 further comprising an inlet manifold coupling said first channel to said second channel at a first end of the first channel and the first end of the second channel, and an outlet manifold coupling said second end of the first channel to the second end of the second channel , said outlet manifold and said inlet manifold coupling said first channel and said second channel in parallel.

19. A rotating machine as recited in claim 17 further comprising a coupler coupling said first channel to said second channel in series.

20. A rotating machine as recited in claim 9 wherein said fluid channel has a spiral shape.

21. A rotating machine as recited in claim 9 further comprising a second channel concentric with said first channel.

22. A rotating machine as recited in claim 21 wherein said first channel and said second channel are spiral-shaped.

23. A rotating machine as recited in claim 21 wherein said first channel is separated from said second channel by a sealing land.

24. A rotating machine as recited in claim 21 wherein said first fluid channel extends partially around said casing and said second fluid channel extends partially around said casing so that a common path on said rotor is traversed by said first fluid channel and said second fluid channel.

25. A rotating machine as recited in claim 9 wherein said casing has a central port, said rotor having a plurality of axially disposed vanes.

26. A rotating machine as recited in claim 9 wherein said rotor comprises an end portion coupled to a cylindrical portion, said apertures located on said cylindrical portion.

27. A rotating machine as recited in claim 9 wherein said channel has a helical shape.

28. A rotating machine as recited in claim 9 wherein said rotor comprises an end portion and a conical portion, said apertures located on the conical portion.

29. A rotating machine comprising:

a casing defining a space therein;

a fluid channel formed in said casing having a plurality of first portions fluidically coupled to and alternating with a plurality of second portions, said first portions and the second portions separated by said space;

one of said plurality of first portions and one of said plurality of second portions defining one of a plurality of stages, each of said stages having a diffuser having a first cross-sectional area located in a first portion and a nozzle having a second cross-sectional area less than the first cross-section area located downstream in the second portion, said stages disposed in series to form a continuous fluid path through the rotating machine; and a rotor rotatably coupled within the casing, said rotor having a plurality of apertures therethrough positioned within the space, said apertures being adjacent to said channel, said apertures fluidically coupling said first portion and said second portion, said rotor having a direction of travel, whereby a fluid within the fluid path moves in the direction of travel in the first portion and the second portion.

30. A pump as recited in claim 29 wherein said apertures have a cylindrical cross-sectional shape.

31. A rotating machine as recited in claim 29 wherein said apertures have an hour-glass cross-sectional shape.

32. A rotating machine as recited in claim 31 wherein said hour-glass cross-sectional shape has a first cone and a second cone oppositely oriented from said first cone.

33. A rotating machine as recited in claim 29 wherein said plurality of apertures comprises a plurality of vanes.

34. A rotating machine as recited in claim 33 wherein said vanes have a vane inlet and a vane outlet, the vane inlet having an angle corresponding to a fluid angle.

35. A rotating machine as recited in claim 29 wherein said channel is generally sinusoidal in shape.

36. A rotating machine as recited in claim 29 wherein said casing defines a second space therein, said rotor comprises a first disc portion and a second disc portion, said first disc portion positioned within said first space and said second disc portion positioned within said second space.

37. A rotating machine as recited in claim 29 further comprising a first fluid channel having a first end and a second end and a second fluid channel having a first end and a second end, said first channel and said second channel adjacent to said first disc and said second disc respectively.

38. A rotating machine as recited in claim 37 further comprising an inlet manifold coupling said first channel to said second channel at the first end of the first channel and the first end of the second channel, and an outlet manifold coupling said second end of the first channel to the second end of the second channel, said outlet manifold and said inlet manifold coupling said first channel and said second channel in parallel.

39. A rotating machine as recited in claim 37 further comprising a coupler coupling said first channel to said second channel in series.

40. A rotating machine as recited in claim 29 wherein said fluid channel has a spiral shape.

41. A rotating machine as recited in claim 29 further comprising a second channel concentric with said first channel.

42. A rotating machine as recited in claim 41 wherein said first channel and said second channel are spiral-shaped.

43. A rotating machine as recited in claim 41 wherein said first channel is separated from said second channel by a sealing land.

44. A rotating machine as recited in claim 41 wherein said first fluid channel extends partially around said casing and said second fluid channel extends partially around said casing so that a common path on said rotor is traversed by said first fluid channel and said second fluid channel.

45. A rotating machine as recited in claim 29 wherein said casing has a central port, said rotor having a plurality of axially disposed vanes.

46. A rotating machine as recited in claim 29 wherein said rotor comprises an end portion coupled to a cylindrical portion, said apertures located on said cylindrical portion.

47. A rotating machine as recited in claim 29 wherein said channel has a helical shape.

48. A rotating machine as recited in claim 29 wherein said rotor comprises an end portion and a conical portion, said apertures located on the conical portion.

* * * * *